US011255518B2

(12) United States Patent
Suzuki

(10) Patent No.: US 11,255,518 B2
(45) Date of Patent: Feb. 22, 2022

(54) LIGHT SOURCE UNIT

(71) Applicant: KOITO MANUFACTURING CO., LTD., Tokyo (JP)

(72) Inventor: Tetsuya Suzuki, Shizuoka (JP)

(73) Assignee: KOITO MANUFACTURING CO., LTD., Tokyo (JP)

( * ) Notice: Subject to any disclaimer, the term of this patent is extended or adjusted under 35 U.S.C. 154(b) by 51 days.

(21) Appl. No.: 16/771,900

(22) PCT Filed: Dec. 12, 2018

(86) PCT No.: PCT/JP2018/045631
§ 371 (c)(1),
(2) Date: Jun. 11, 2020

(87) PCT Pub. No.: WO2019/117190
PCT Pub. Date: Jun. 20, 2019

(65) Prior Publication Data

US 2021/0071851 A1 Mar. 11, 2021

(30) Foreign Application Priority Data

Dec. 13, 2017 (JP) ..... JP2017-238240
Dec. 13, 2017 (JP) ..... JP2017-238241

(51) Int. Cl.
*F21V 19/00* (2006.01)
*F21S 41/19* (2018.01)
(Continued)

(52) U.S. Cl.
CPC ..... *F21V 19/003* (2013.01); *F21S 41/192* (2018.01); *F21V 23/06* (2013.01);
(Continued)

(58) Field of Classification Search
None
See application file for complete search history.

(56) References Cited

U.S. PATENT DOCUMENTS 6,123,558 A 9/2000 Shibata
2001/0034156 A1 10/2001 Yamane
(Continued)

FOREIGN PATENT DOCUMENTS

JP H11-144808 A 5/1999
JP 2001-307831 A 11/2001
(Continued)

OTHER PUBLICATIONS

Feb. 26, 2019, International Search Report issued for related PCT Application No. PCT/JP2018/045631.
(Continued)

*Primary Examiner* — Ashok Patel
(74) *Attorney, Agent, or Firm* — Paratus Law Group, PLLC

(57) ABSTRACT

A light source unit includes a card type light source including a card substrate on which a light source is mounted, and a power supply connector configured to supply power to the light source. A card edge connector is formed on a part of the card substrate. The power supply connector is configured to be fitted to the card type light source via the card edge connector. The card type light source is provided with an alignment groove for confirming an alignment state with respect to the power supply connector.

13 Claims, 14 Drawing Sheets

(51) Int. Cl.

| | |
|---|---|
| ***F21V 23/06*** | (2006.01) |
| ***H01R 12/70*** | (2011.01) |
| ***H01R 12/72*** | (2011.01) |
| *F21S 45/435* | (2018.01) |
| *F21S 45/47* | (2018.01) |

(52) U.S. Cl.
CPC ..... *H01R 12/7005* (2013.01); *H01R 12/721* (2013.01); *F21S 45/435* (2018.01); *F21S 45/47* (2018.01)

(56) References Cited

U.S. PATENT DOCUMENTS

| | | | | |
|---|---|---|---|---|
| 2014/0226315 | A1* | 8/2014 | Nicieja | A47F 3/001 362/127 |
| 2018/0241141 | A1* | 8/2018 | Roldan | H05K 3/326 |

FOREIGN PATENT DOCUMENTS

| | | | |
|---|---|---|---|
| JP | 2006-351695 | A | 12/2006 |
| JP | 2010-278029 | A | 12/2010 |
| JP | 2017-152371 | A | 8/2017 |

OTHER PUBLICATIONS

Feb. 26, 2019, International Search Opinion issued for related PCT Application No. PCT/JP2018/045631.

* cited by examiner

LIGHT SOURCE UNIT

CROSS REFERENCE TO PRIOR APPLICATION

This application is a National Stage Patent Application of PCT International Patent Application No. PCT/JP2018/045631 (filed on Dec. 12, 2018) under 35 U.S.C. § 371, which claims priority to Japanese Patent Application Nos. 2017-238240 (filed on Dec. 13, 2017) and 2017-238241 (filed on Dec. 13, 2017), which are all hereby incorporated by reference in their entirety.

TECHNICAL FIELD

The present disclosure relates to a light source unit provided in a vehicle lamp, and more particularly to a light source unit including a card type light source in which a light source is mounted on a card-shaped substrate.

BACKGROUND ART

In a vehicle lamp for an automobile or the like, there has been proposed in recent years a light source device (light source unit) in which a light emitting element such as a light emitting diode (LED) or a laser diode (LD) is unitized as a light source. Such a light source unit is configured such that one or a plurality of light emitting elements are mounted on a card-shaped substrate (hereinafter, referred to as a card substrate) to constitute a card type light source, and the card type light source is incorporated in a lamp and electrically connected to an in-vehicle power source such that power is supplied to the light emitting element.

A related-art light source unit using such a card type light source is configured such that a separate power receiving connector is mounted on a part of a card substrate having a predetermined shape, and the power receiving connector and a power supply connector connected to an in-vehicle power source are fitted together so as to supply power to the light emitting element.

This configuration requires working operations for mounting the power receiving connector on the card substrate. Further, mounting the power receiving connector on the card substrate limits size reduction of the card type light source.

Accordingly, for example, Patent Document 1 proposes a card type light source in which a card edge connector is formed by providing an electrode pad on one side of a card substrate as a power receiving connector. This card type light source eliminates the need for mounting a separate connector and enables reduction of working operations and size reduction.

CITATION LIST

Patent Document

Patent Document 1: JP-A-2017-152371

SUMMARY OF INVENTION

Technical Problem

Patent Document 1 does not describe a specific configuration for supplying power to the card edge connector formed on the card type light source. In general, a power supply connector for fitting to the card edge connector is provided to make electrical connection. The power supply connector is provided with an electrode terminal in a groove provided on a connector body, and when the card edge connector is inserted into the groove, the electrode terminal comes into contact with an electrode pad of the card edge connector and is electrically conducted.

Accordingly, when the card type light source having the card edge connector is fitted to the power supply connector to make electric connection, in an assembly process for fitting them, they may not be sufficiently fitted due to unfamiliarity of a worker. When such insufficient fitting state (hereinafter referred to as a half-fitting state) occurs, fitting between the card type light source and the power supply connector may be disengaged during the assembly process of a light source unit or a lamp unit. Such disengagement between the card type light source and the power supply connector may cause assembly failure of the lamp unit.

Further, when the card type light source is incorporated into the lamp unit in the half-fitting state, electrical contact between the card type light source and the power supply connector is not sufficient. When the electrical contact between the card type light source and the power supply connector is not sufficient, an increase in electric resistance and heat generation at the time of lighting become significant, and reliability of the light source unit or the lamp unit deteriorates.

When the card edge connector is provided in the card type light source and the card edge connector is inserted into the groove of the power supply connector, a connector body of the power supply connector protrudes on both a front surface and a back surface of the card type light source. Therefore, when the light source unit is incorporated in the lamp unit, that is for example, when the card type light source is attached to a main surface of a base portion of a heat sink, the power supply connector interferes with the main surface of the base portion, and the card type light source cannot be attached in close contact with the main surface. Therefore, when an optical axis of the light emitting element is positioned with reference to the main surface of the base portion, a positioning accuracy may deteriorates, which adversely affects and light distribution characteristics of the lamp.

In order to avoid such problem, it is conceivable to prevent interference between the power supply connector and the base portion by configuring the lamp unit such that the card edge connecter extends outward from the main surface of the base portion and is fitted to the power supply connector.

However, in this case, the power supply connector protrudes outward from the base portion, which makes it difficult to reduce the size of the light source unit.

Further, when the card type light source is mounted on the base portion with the card type light source and the power supply connector fitted together, if the card type light source and the power supply connector are in the half-fitting state, it may be difficult or not possible to attach the card type light source to a predetermined position on the main surface of the base portion. In such a case, a work operation of correcting the fitting state between those is required, so that the assembling process of the lamp unit becomes complicated, which causes delay.

Further, when the card type light source is attached to the base portion while the card type light source and the power supply connector are in the half-fitting state, electrical contact between the card type light source and the power supply connector is not sufficient. When the electrical contact between the card type light source and the power supply connector is not sufficient, an increase in electric resistance and heat generation at the time of lighting become significant, and reliability of the light source device or the lamp unit deteriorates.

Accordingly, a first object of the present disclosure is to provide a light source unit capable of preventing a half-fitting state between a card type light source and a power supply connector electrically connected to the card type light source via a card edge connector provided on the card type light source.

A second object of the present disclosure is to provide a compact light source unit in which a card type light source can be correctly mounted in a lamp, and a half-fitting state between the card type light source and a power supply connector can be prevented.

Solution to Problem

In order to achieve the first object, a light source unit according to an aspect of the present disclosure includes: a card type light source including a card substrate on which a light source is mounted; and a power supply connector configured to supply power to the light source, wherein a card edge connector is formed on a part of the card substrate, the power supply connector is configured to be fitted to the card type light source via the card edge connector, and one of the card type light source and the power supply connector is provided with an alignment portion for confirming an alignment state with respect to the other.

A preferred embodiment of the alignment portion in the light source unit according to an aspect of the present disclosure may include an alignment groove formed on the card type light source and extending in a direction in which the card type light source is to be fitted to the power supply connector, and the alignment groove is configured to be covered to be hidden by the power supply connector when the card type light source is correctly fitted to the power supply connector.

In order to achieve the second object, alight source unit according to an aspect of the present disclosure includes: a card type light source including a card substrate on which a light source is mounted; a power supply connector configured to supply power to the light source; and a base portion to which the card type light source is attached, wherein a card edge connector is formed on a part of the card substrate, the power supply connector is configured to be fitted to the card type light source via the card edge connector, and the base portion is formed with a step portion in a region corresponding to the power supply connector.

In the light source unit according to an aspect of the present disclosure, one of the card type light source and the power supply connector may be provided with an alignment portion for confirming an alignment state with respect to the other.

Advantageous Effects of Invention

According to the light source unit according to an aspect of the present disclosure, by fitting the card type light source and the power supply connector while observing the alignment portion, a correct fitting state between the card type light source and the power supply connector can be confirmed. For example, the correct fitting state can be confirmed by confirming a state where the alignment groove as the alignment portion is covered to be hidden.

According to the light source unit according to an aspect of the present disclosure, the outside dimension can be reduced while the card type light source is suitably mounted in a lamp even in a state where the power supply connector is fitted to the card type light source. Further, according to the light source unit according to an aspect of the present disclosure, it is possible to prevent a half-fitting state between a card type light source and a power supply connector and to configure a light source unit having enhanced reliability.

DESCRIPTION OF EMBODIMENTS

First Embodiment

Figure 1:
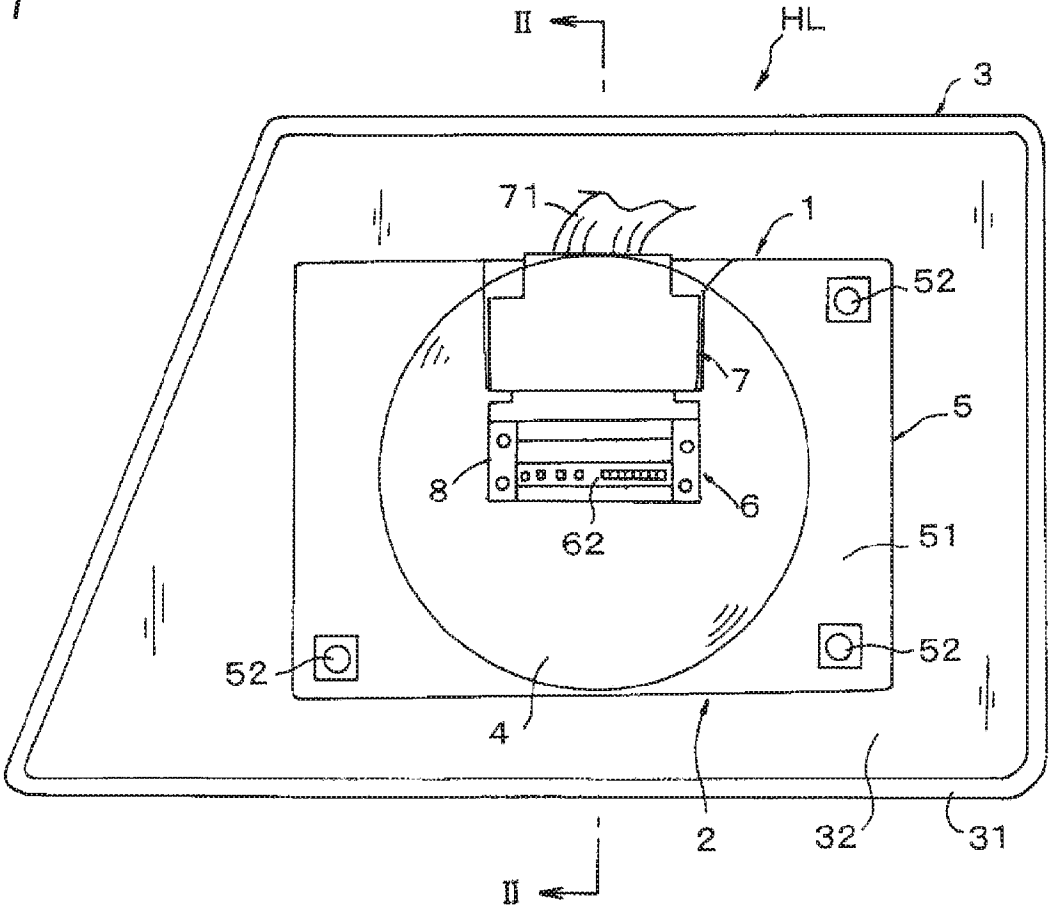
FIG. 1 is a front view of a headlamp including a light source unit according to a first embodiment where the light source unit is shown in a see-through manner.
Figure 2:
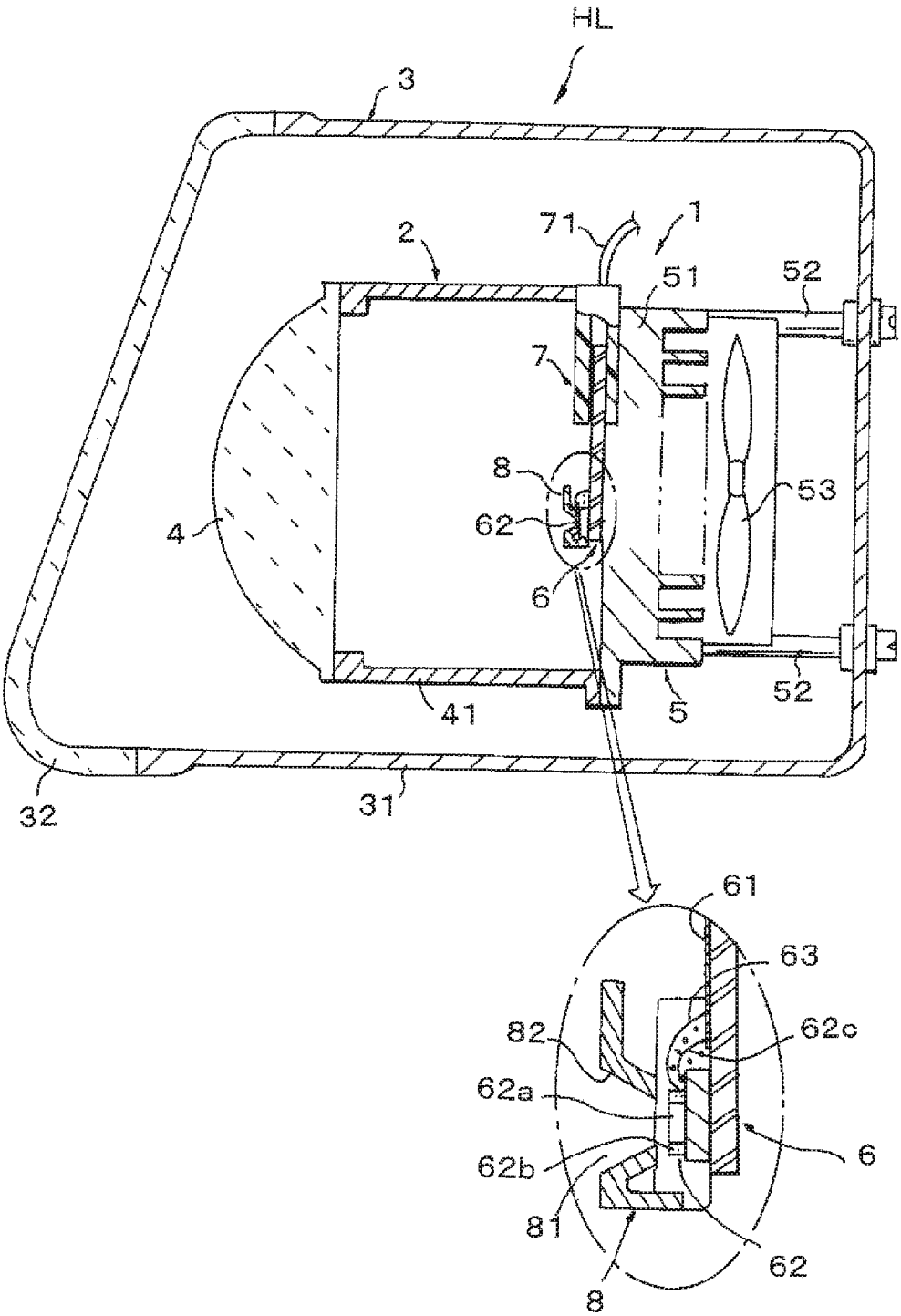
FIG. 2 is a cross-sectional view taken along line II-II of FIG. 1 and a partial enlarged view of the cross-sectional view.

Next, a first embodiment of the present disclosure will be described with reference to the drawings. FIG. 1 is a front view of an automotive headlamp HL including a light source unit according to the first embodiment. FIG. 1 illustrates a part of the light source unit in a see-through manner. FIG. 2 is a cross-sectional view taken along line II-II of FIG. 1 and a partial enlarged view of the cross-sectional view.

As shown in FIGS. 1 and 2, a lamp housing 3 includes a lamp body 31 and a light-transmitting cover 32 attached to a front opening of the lamp body 31. A lamp unit 2 that makes light illumination with a predetermined light distribution is provided in the lamp housing 3. In the present embodiment, the lamp unit 2 is a lamp unit having a high-beam light distribution.

The lamp unit 2 includes alight source unit 1 and a projection lens 4 that projects light emitted from the light source unit 1 onto a front region of an automobile.

The light source unit 1 includes a heat sink 5. The heat sink 5 includes abase portion 51 having a substantially flat plate shape. The heat sink 5 is attached to the lamp body 31 by a known aiming mechanism 52 at three positions in a peripheral portion of the base portion 51. The aiming mechanism 52 is, for example, an aiming screw. Although details of the aiming mechanism 52 are omitted, the base portion 51 of the heat sink 5 can be tilted in an upper-lower direction and a left-right direction by performing aiming adjustment.

The base portion 51 is disposed such that a main surface of the base portion 51 is directed forward of the lamp unit 2. A card type light source 6 is attached to the main surface of the base portion 51. A heat dissipation fan 53 is attached to a rear surface of the heat sink 5. The heat dissipation fan 53 enhances a heat dissipation effect of heat generated by the card type light source 6.

A reflector 8 is attached to the main surface of the base portion 51 together with the card type light source 6. As shown in the partially enlarged view in FIG. 2, the reflector 8 has an opening 81 through which light emitted from the card type light source 6 passes, and a reflecting surface 82 that reflects light. The reflector 8 reflects the light emitted from the card type light source 6 in a predetermined direction. At this time, a part of the light emitted from the card type light source 6 is blocked by the reflector 8.

The projection lens 4 is attached to the base portion 51 by a lens holder 41. The projection lens 4 projects the light emitted from the card type light source 6 and reflected by the reflector 8 forward of the lamp unit 2. The light projected forward by the projection lens 4 is radiated with a predetermined light distribution in a front region of the automobile.

The light source unit 1 includes a power supply connector 7 electrically connected to the card type light source 6. The power supply connector 7 is connected to an in-vehicle power source of the automobile, which not shown in the drawing, via an electric cord 71. The power supply connector 7 is fitted to the card type light source 6 through a card edge connector 64 (described later) so as to be electrically connected to the card type light source 6, and supplies power of the in-vehicle power source to the card type light source 6 to cause the card type light source 6 to emit light.

Figure 3:
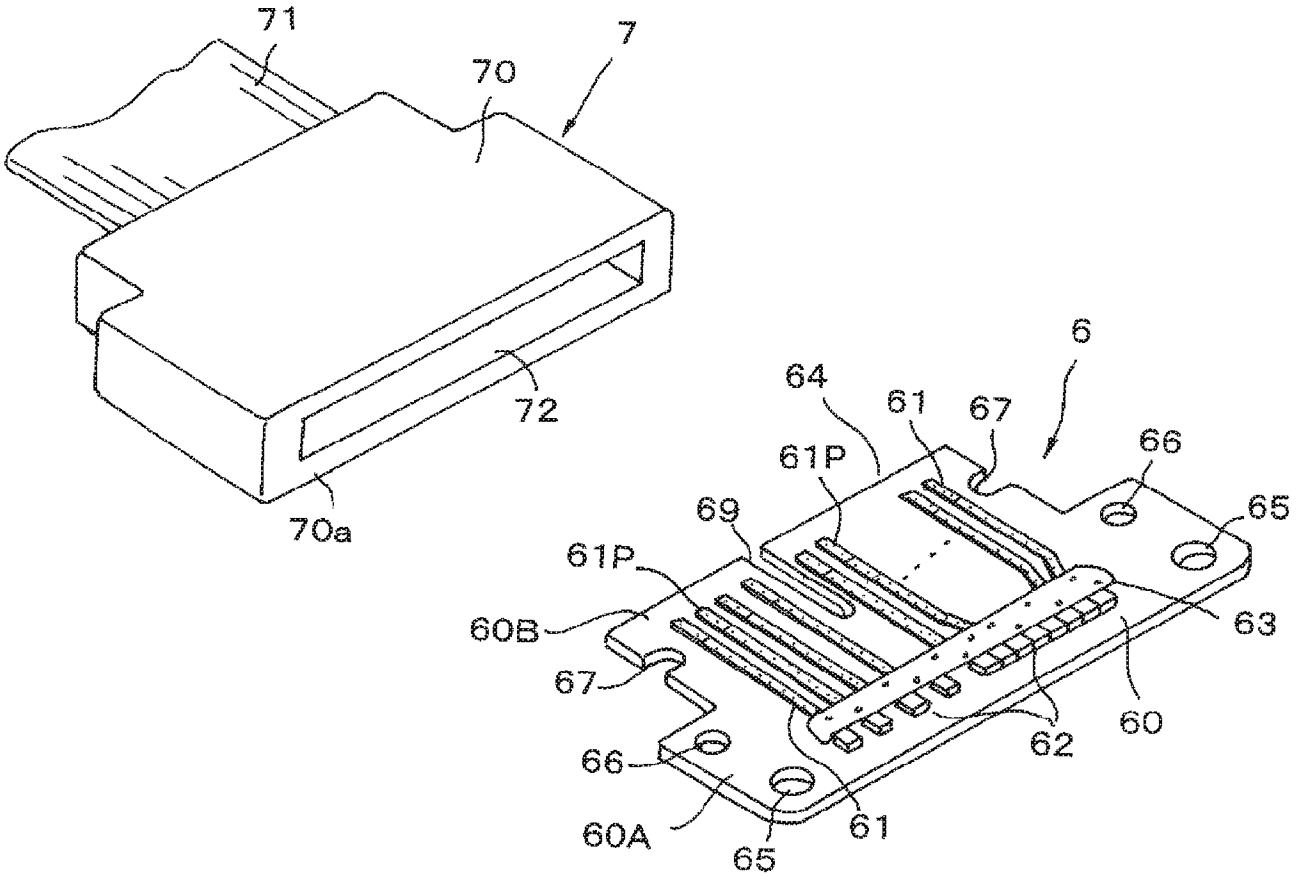
FIG. 3 is a schematic perspective view of a card type light source and a power supply connector.
Figure 4:
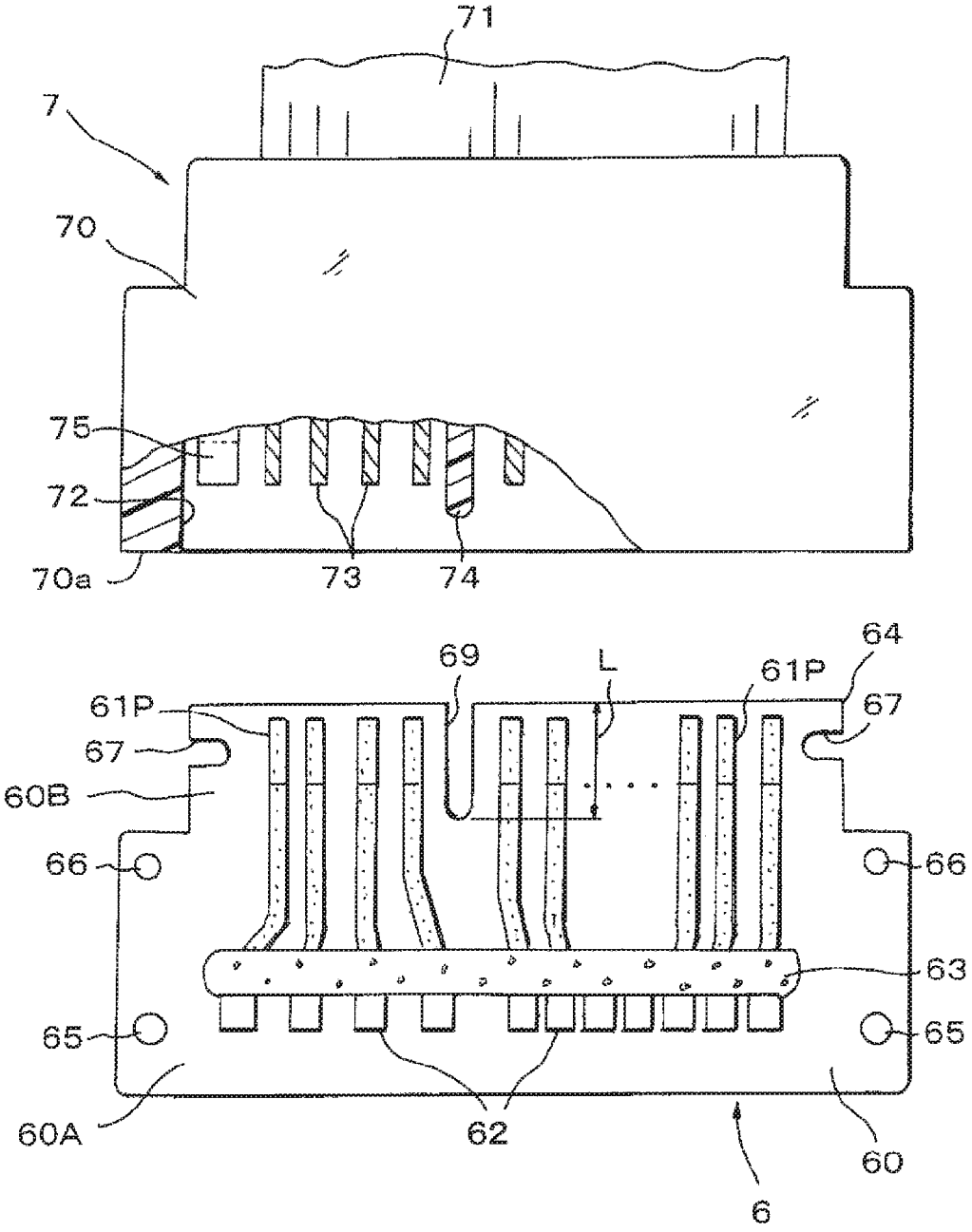
FIG. 4 is a front view of the card type light source and the power supply connector.

FIG. 3 is a perspective view schematically showing an appearance of the card type light source 6 and the power supply connector 7, and FIG. 4 is a front view of the card type light source 6 and the power supply connector 7 with a part thereof shown in a see-through manner.

The card type light source 6 mainly includes a card substrate 60 having a predetermined shape. The card substrate 60 has a plurality of conductive patterns 61 obtained by forming a conductive film on one surface of an insulating substrate in a predetermined pattern. On the surface having the conductive patterns 61 of the card substrate 60, LEDs 62 as a plurality of light emitting elements are surface-mounted. In the card substrate 60, a surface on which the LEDs 62 are mounted is referred to as a front surface, and an opposite surface is referred to as a back surface.

The card substrate 60 includes an element mounting portion 60A and a connector portion 60B. The element mounting portion 60A is formed at a predetermined width dimension in the width direction (the left-right direction in FIG. 4). A width dimension of the connector portion 60B is reduced on both sides to become shorter than the width dimension of the element mounting portion 60A. The plurality of conductive patterns 61 are formed over both portions from the element mounting portion 60A to the connector portion 60B. In the element mounting portion 60A, portions of the conductive patterns 61 are configured as mounting lands (not shown) of the plurality of LEDs 62. In the connector portion 60B, other portion of the conductive patterns 61 are configured as connector electrode pads 61P (described later).

In the element mounting portion 60A, the plurality of mounting lands are arranged substantially in a row in the width direction. The LEDs 62 are surface-mounted respectively on the mounting lands by soldering or the like. As shown in the partially enlarged view in FIG. 2, each LED 62 includes a light emitting surface portion 62*a* and a light reflecting portion 62*b*. The light emitting surface portion 62*a* is provided in a state directed forward of the lamp unit 2. The light reflecting portion 62*b* is provided so as to surround the light emitting surface portion 62*a*. The light reflecting portion 62*b* reflects light emitted from the light emitting surface portion 62*a* toward a side of the lamp unit 2, forward of the lamp unit 2. Each LED 62 is electrically connected to one end of each conductive pattern 61 by a bonding wire 62*c*. The bonding wires 62*c* are sealed with a resin 63.

The conductive patterns 61 electrically connected to the LEDs 62 are formed such that the other end portion of each of the conductive patterns 61 is extended to an edge portion of the connector portion 60B. The other end portions of the conductive patterns 61 are arranged in the width direction of the connector portion 60B along the edge portion of the connector portion 60B and are configured as connector electrode pads 61P. By forming these connector electrode pads 61P, the edge portion of the connector portion 60B is configured as the card edge connector 64.

Each of both end portions in the width direction of the element mounting portion 60A is formed with a pair of circular holes 65, 66 penetrating in a plate thickness direction. Among the paired holes 65, 66, the holes 65, 65 on a lower side in FIG. 4 are formed slightly larger in diameter than the other holes 66, 66. The large-diameter holes 65 are configured as attachment holes for attaching the card type light source 6 to the base portion 51. The small-diameter holes 66 are configured as positioning holes for positioning the card type light source 6 with respect to the base portion 51.

A notch groove 69 is formed in the connector portion 60B. The notch groove 69 is a single small-width linear groove extending perpendicularly from the edge portion constituting the card edge connector 64 toward the element mounting portion 60A and penetrates in the plate thickness direction of the card substrate 60. The notch groove 69 is formed between predetermined connector electrode pads 61P, 61P among the plurality of connector electrode pads 61P arranged in parallel. A length L of the notch groove 69 is accurately determined such that a base end portion of the notch groove 69 is at a specific position on the front surface of the card substrate 60. The notch groove 69 is configured as an alignment groove for confirming a fitting state with the power supply connector 7 and is an example of an alignment portion according to the present disclosure.

The alignment groove 69 is formed at a position shifted to one side of a central position in an arrangement direction of the plurality of connector electrode pads 61P provided on the connector portion 60B (the width direction of the connector portion 60B).

As shown in FIGS. 3 and 4, each of both ends in the width direction of the connector portion 60B of the card type light source 6 is formed with a notch 67 toward an inner width direction of the connector portion 60B. The notches 67 are configured as engagement grooves 67.

On the other hand, as shown in FIGS. 3 and 4, the power supply connector 7 as one of the components of the light source unit 1 includes a connector body 70 formed of resin and having a flat rectangular tube shape. The card edge connector 64 of the card type light source 6 is inserted into a tubular groove 72 opened on one end surface (hereinafter referred to as a front surface) 70*a* of the power supply connector 7. In the tubular groove 72 of the connector body 70, connector electrode terminals 73 formed of a conductive member such as metal are respectively arranged at positions corresponding to the plurality of connector electrode pads 61P constituting the card edge connector 64. When the card edge connector 64 is inserted, the connector electrode terminals 73 are in contact and electrically connected with the connector electrode pads 61P respectively corresponding to the respective connector electrode terminals 73. The electric cord 71 is connected to each connector electrode terminal 73.

Here, a length in the fitting direction of the tubular groove 72 of the connector body 70 into which the card edge connector 64 is inserted is equal to the length L of the alignment groove 69.

The tubular groove 72 of the connector body 70 is formed with a rib 74 for enhancing a strength of the connector body 70 in a part that is intermediate in the arrangement direction of the connector electrode terminals 73. The rib 74 is formed at a position corresponding to the alignment groove 69 provided in the card type light source 6. That is, when the card edge connector 64 is inserted into the tubular groove 72, the rib 74 enters the alignment groove 69 to enable the insertion.

As described above, the alignment groove 69 is formed at a position shifted from a center in the width direction of the connector portion 60B, so that the rib 74 is also provided at a position shifted toward one side in the width direction of the connector body 70 corresponding to the position of the alignment groove 69. Therefore, the card type light source 6 is prevented from being fitted to the power supply connector 7 in a front-back reverse manner.

Engagement pieces 75 are provided in the tubular groove 72 of the connector body 70. The engagement pieces 75 are provided at positions on both sides in the width direction in which the connector electrode terminals 73 in the tubular groove 72 are arranged. The engagement pieces 75 are cantilever pieces integrally formed with the connector body 70.

When the card edge connector 64 is inserted into the tubular groove 72, the engagement pieces 75 are engaged to the engagement grooves 67 of the connector portion 60B. The card type light source 6 is prevented from being easily detached from the connector body 70 by an engagement force between the engagement pieces 75 and the engagement grooves 67.

Here, a dimension in an axial direction of the tubular groove 72 of the connector body 70, that is, a dimension in the direction in which the card type light source 6 is fitted, is formed such that the front surface 70*a* of the connector body 70 coincides with the base end portion of the alignment groove 69 when the card edge connector 64 is inserted into the predetermined correct position in the power supply connector 7.

Figure 5:
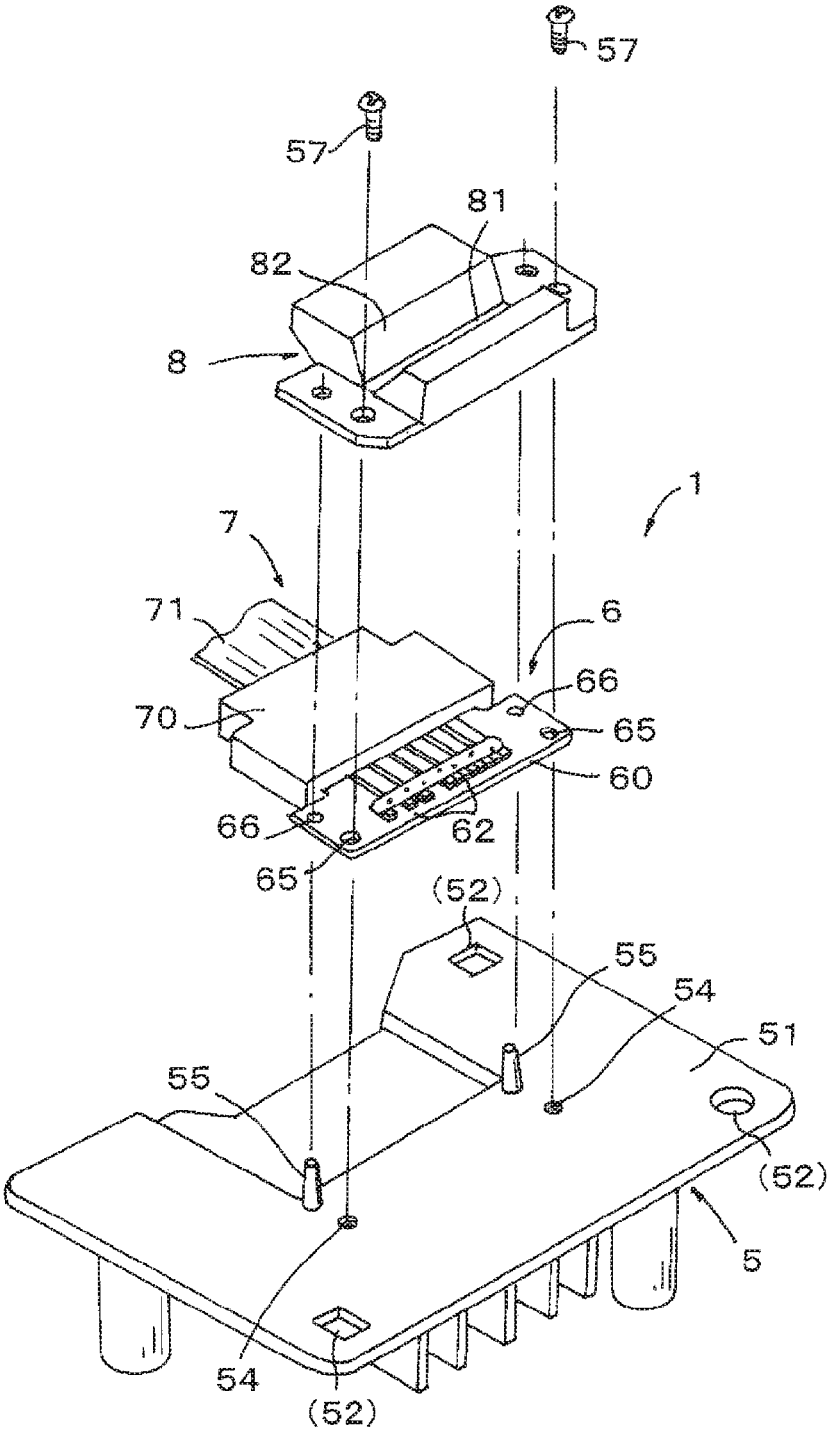
FIG. 5 is an exploded perspective view of the light source unit.

The card type light source 6 and the power supply connector 7 configured as described above are attached to the base portion 51 of the heat sink 5 in a mutually fitted state. FIG. 5 is an exploded perspective view of the light source unit 1. Attachment screw holes 54 are formed in the main surface of the base portion 51 of the heat sink 5 respectively at positions corresponding to the attachment holes 65 of the card type light source 6. Further, columnar positioning bosses 55 are erected on the main surface of the base portion 51 respectively at positions corresponding to the positioning holes 66.

Figure 6A:
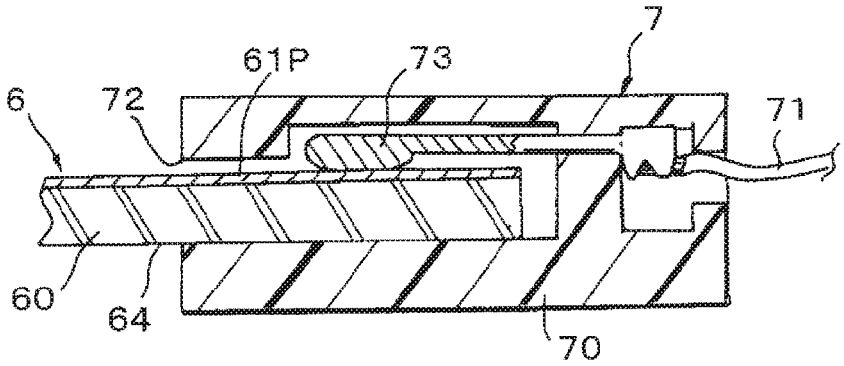
FIG. 6A is a cross-sectional view of a state where a card edge connector of the card type light source and the power supply connector are fitted together.
Figure 6B:
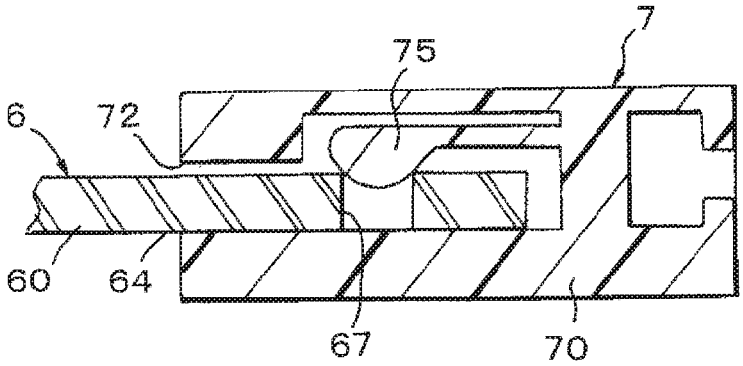
FIG. 6B is a cross-sectional view of a state where the card edge connector of the card type light source and the power supply connector are fitted together.

In order to assemble the light source unit 1, first, the card type light source 6 is fitted to and integrated with the power supply connector 7. Specifically, the card edge connector 64 of the card type light source 6 is inserted into the tubular groove 72 from the front surface 70*a* side of the connector body 70 of the power supply connector 7. FIGS. 6A and 6B are cross-sectional views when the card type light source 6 is inserted into the power supply connector 7. As shown in FIG. 6A, the plurality of connector electrode terminals 73 of the power supply connector 7 are respectively brought into contact with the plurality of connector electrode pads 61P on the front surface of the card substrate 60 constituting the inserted card edge connector 64. Thus, the connector electrode pads 61P and the connector electrode terminals 73 are electrically connected to each other.

Further, when the card edge connector 64 is inserted, as shown in FIG. 6B, hook-like ends of the engagement pieces 75 at the positions on both sides of the connector body 70 are respectively engaged to the engagement grooves 67 of the card type light source 6. When the tip ends of the engagement pieces 75 respectively enter the engagement grooves 67, a click feeling is generated between the engagement pieces 75 and the engagement grooves 67. By this click feeling, the fitting state between the card type light source 6 and the power supply connector 7 can be confirmed via a tactile sense. The card type light source 6 can become unlikely to be detached from the connector body 70 by the engagement force between the engagement pieces 75 and the engagement grooves 67.

Next, as shown in FIG. 5, the card type light source 6 to which the power supply connector 7 is fitted is attached to the base portion 51. During the attachment, positioning of the card type light source 6 is performed by inserting the positioning bosses 55 of the base portion 51 into the positioning holes 66 of the card type light source 6. Next, attachment screws 57 are respectively screwed into the attachment screw holes 54 of the base portion 51 while being inserted into the attachment holes 65 of the card type light source 6, so that the card type light source 6 is fixedly attached to the base portion 51.

In this embodiment, at the same time as attaching the card type light source 6, the reflector 8 is integrally attached to the base portion 51 by the attachment screws 57 in a state where the reflector 8 is overlapped with the card type light source 6. Accordingly, the assembly of the light source unit 1 is completed. Thereafter, although a detailed description is omitted, as shown in FIG. 2, the projection lens 4 is attached to the base portion 51 through the lens holder 41, so as to constitute the lamp unit 2.

In the lamp unit 2 assembled as described above, when the card type light source 6 and the power supply connector 7 are fitted together, the power of the in-vehicle power source is supplied to the card type light source 6, so that the LEDs 62 emit light. The light emitted from the LEDs 62 passes through the opening 81 of the reflector 8 shown in FIG. 2 and is partially reflected by the reflection surface 82, and then projected forward of the lamp unit 2 by the projection lens 4. Accordingly, the lamp unit 2 i.e. the headlamp HL becomes alighting state, and the front area of the automobile is illuminated.

During the assembly of the light source unit 1, the power supply connector 7 is fitted to the card type light source 6. At the assembly, if the fitting between the card type light source 6 and the power supply connector 7 are in a half-fitting state where the fitting is not sufficient, the card type light source 6 and the power supply connector 7 may be disengaged during the assembly process of the lamp unit 2 as described above, which causes an assembly process failure of the lamp unit 2. If the lamp unit 2 is assembled to the headlamp HL while the card type light source 6 and the power supply connector 7 are in the half-fitting state, an electric resistance in electrical connection between the card type light source 6 and the power supply connector 7 becomes significant, and reliability of the lamp unit 2 or the head lamp HL may deteriorate.

In order to prevent the half-fitting state in the assembly, the fitting state can be confirmed by utilizing the click feeling when the engagement pieces 75 and the engagement grooves 67 shown in FIG. 6B are engaged. However, this click feeling depends on the tactile sense of the assembly worker and has an individual difference in the feeling. For this reason, it is difficult to reliably prevent the half-fitting state between the card type light source 6 and the power supply connector 7 only via the tactile sense, which has an individual difference.

Figure 7A:
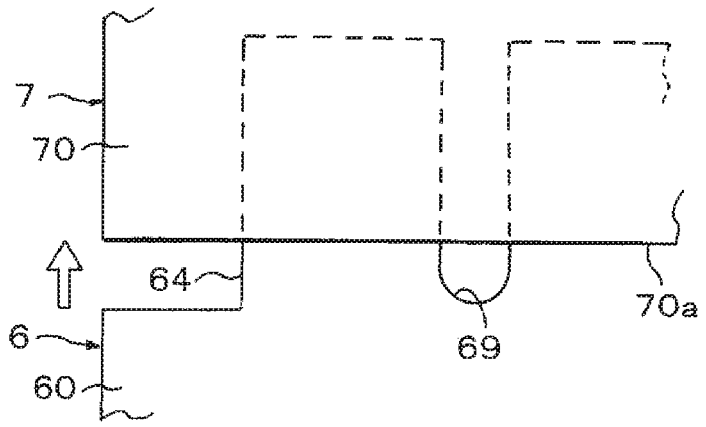
FIG. 7A is a schematic view illustrating a method of confirming a fitting state between the card edge connector and the power supply connector using an alignment groove.
Figure 7B:
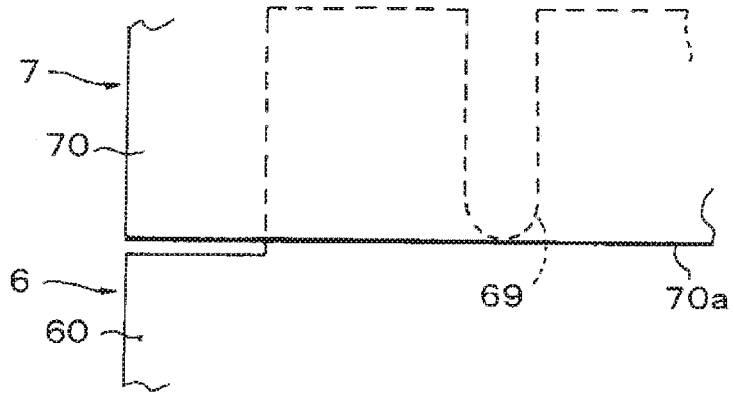
FIG. 7B is a schematic view illustrating the method of confirming the fitting state between the card edge connector and the power supply connector using the alignment groove.

In order to reliably prevent this half-fitting state, in the light source unit 1 of the present embodiment, the alignment groove 69 serving as the alignment portion provided in the card type light source 6 functions effectively. FIGS. 7A and 7B are front views for explaining this alignment and schematically illustrate a method of confirming the fitting state between the card edge connector 64 and the power supply connector 7 using the alignment groove 69. As shown in FIG. 7A, when the card edge connector 64 of the card type light source 6 is inserted into and fitted with the power supply connector 7, the front surface 70*a* of the connector body 70 is moved along the alignment groove 69, and the connector body 70 is moved so as to gradually cover the alignment groove 69.

As described above, the dimension (length) in the fitting direction of the tubular groove 72 of the connector body 70 is equal to the length L of the alignment groove 69. Therefore, as shown in FIG. 7B, when the front surface 70*a* of the connector body 70 is moved to a position coincide with the base end of the alignment groove 69 or the connector body 70 is moved to a position where the connector body 70 completely covers and hides the alignment groove 69, it is confirmed that the power supply connector 7 is fitted to the card type light source 6 up to a correct state. That is, it can be confirmed that the fitting state is the correct state by observing the transmission of light in the alignment groove 69.

As described above, in the light source unit 1 of the present embodiment, when the card type light source 6 and the power supply connector 7 are fitted together, the fitting state thereof can be visually confirmed by using the alignment groove 69. Therefore, even when a difference is present in the feeling of the operator with respect to the click feeling between the engagement pieces 75 and the engagement grooves 67, the fitting state can be reliably confirmed to prevent the half-fitting state, so that the reliability of the light source unit 1 can be improved.

Second Embodiment

Figure 8:
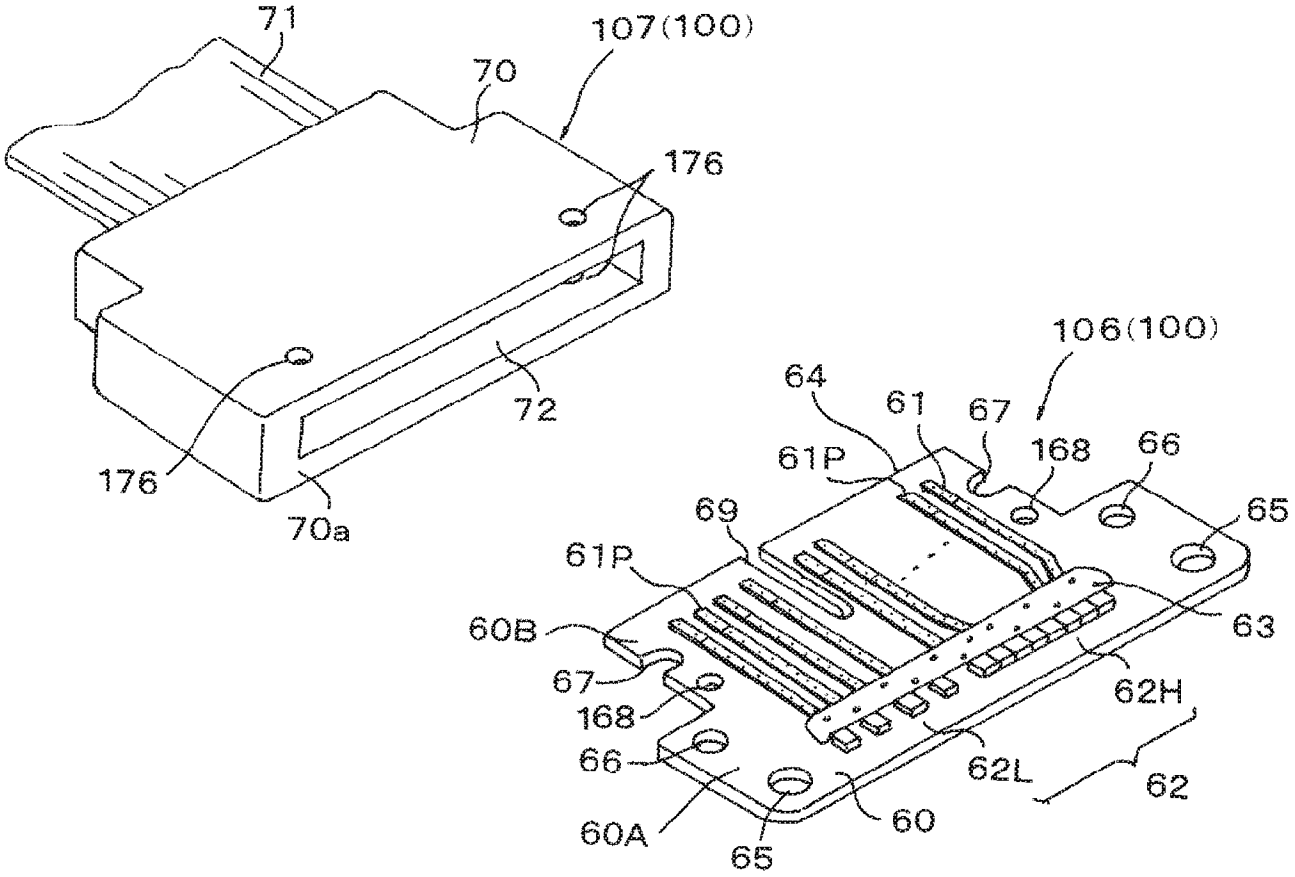
FIG. 8 is a perspective view of a card type light source and a power supply connector according to a second embodiment.
Figure 9:
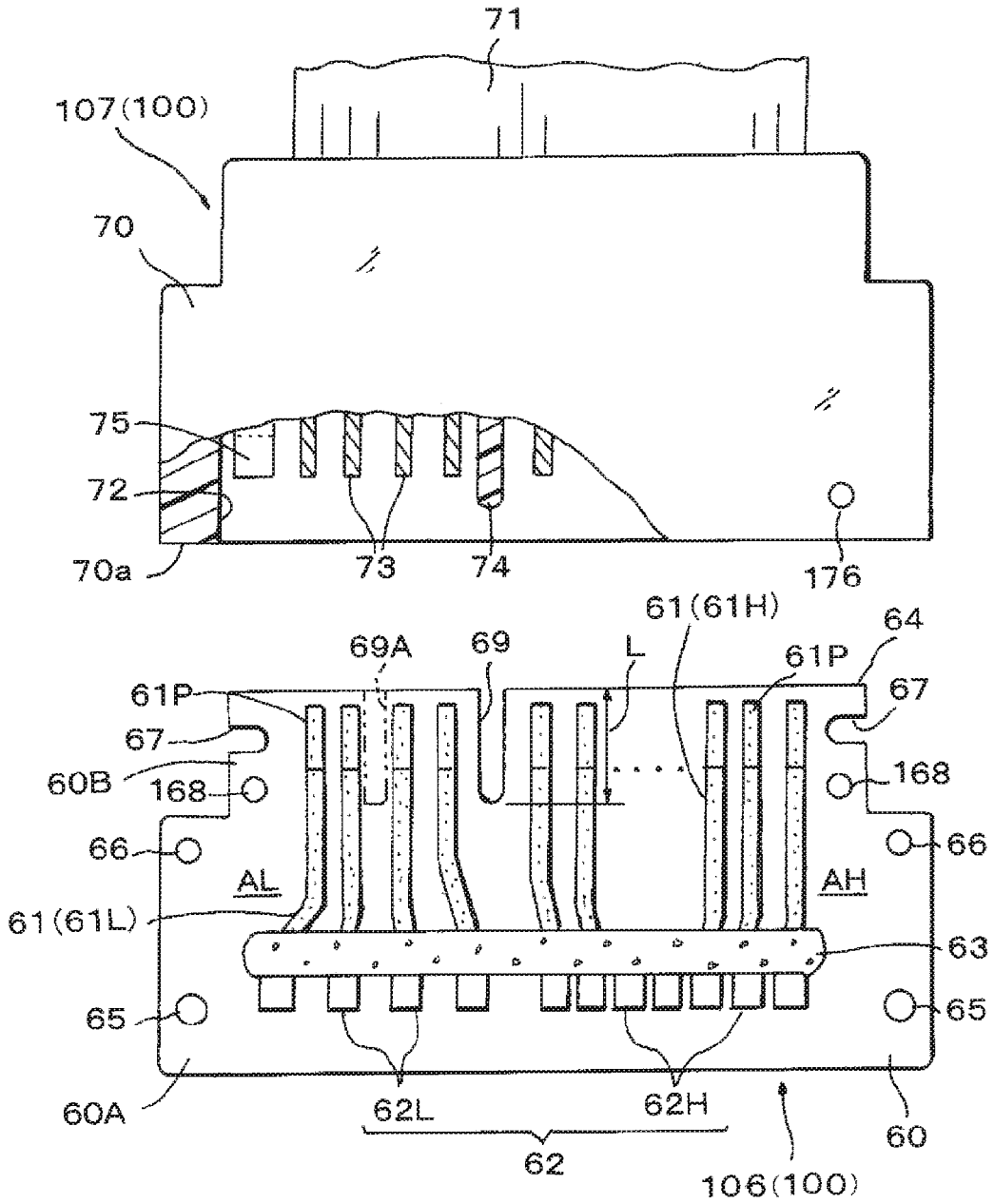
FIG. 9 is a front view of the card type light source and the power supply connector.

Next, a light source unit 100 according to a second embodiment of the present disclosure will be described with reference to the drawings. In the second embodiment, the same or equivalent parts as those in the first embodiment are denoted by the same reference numerals, and the description thereof will be omitted or simplified. FIG. 8 is an external perspective view of a card type light source 106 and a power supply connector 107 of the light source unit 100. FIG. 9 is a front view of the card type light source 106 and the power supply connector 107 with a part thereof shown in a see-through manner.

As shown in FIG. 9, the plurality of LEDs 62 includes LEDs 62H on a right side of the element mounting portion 60A and LEDs 62L on a left side of the element mounting portion 60A. The LEDs 62H are arranged at a high density with a smaller array pitch dimension. The LEDs 62L are arranged at a low density with a larger array pitch dimension. The LEDs 62H on the right side are referred to as high density LEDs, and the left LEDs 62L are referred to as low density LEDs.

In the connector portion 60B, small-diameter circular holes 168, 168 are formed to penetrate in the plate thickness direction of the element mounting portion 60A in the vicinity of the notches 67 (the engagement grooves 67). The circular holes 168 are configured as alignment holes for confirming the fitting state between the power supply connector 107 and the card type light source 106. The alignment holes 168 are an example of the alignment portion in the present disclosure.

The alignment groove 69 is formed in a linear shape extending along a boundary between a region AH of the conductive patterns 61 respectively connected to the high-density LEDs 62H (61H) and a region AL of the conductive patterns 61 respectively connected to the low-density LEDs 62L (61L). Thus, the connector portion 60B is separated into the conductive pattern region AH of the high-density LEDs 62H and the conductive pattern region AL of the low-density LEDs 62L by the alignment groove 69. In the present embodiment, the number of the conductive patterns 61 of the high-density LEDs 62H is larger than the number of the conductive patterns 61 of the low-density LEDs 62L. Therefore, as shown in FIG. 9, the alignment groove 69 is formed at a position shifted toward the lower-density LEDs 62L than the center position in the width direction of the connector portion 60B.

Since the connector portion 60B is separated in the width direction by the alignment groove 69 as described above, heat generated on a side of the high-density LEDs 62H, where an amount of the heat generated per unit area is larger, is prevented from transferring toward the region of the low-density LEDs 62L. Thus, temperature rise on the side of the low-density LEDs 62L can be prevented. Since an area of the conductive pattern region AH on the side of the high-density LEDs 62H is wider than that of the conductive pattern region AL on the side of the low-density LEDs, the heat generated in the high-density LEDs 62H can be effectively dissipated from the front surface and the back surface of the conductive pattern region AH.

The alignment groove 69 may be provided in apart of the conductive pattern region AL. For example, as shown by a virtual line (two-dot chain line) in FIG. 9, the alignment groove 69 may be configured as an alignment groove 69A between the conductive patterns 61L connected to the low-density LEDs 62L. As described above, by forming the alignment groove 69A in the conductive pattern region AL on the low density side, a heat capacity of the card substrate 60 in the conductive pattern region AH is increased and the heat dissipation effect is enhanced without reducing the area of the high density side conductive pattern region AH.

Figure 10:
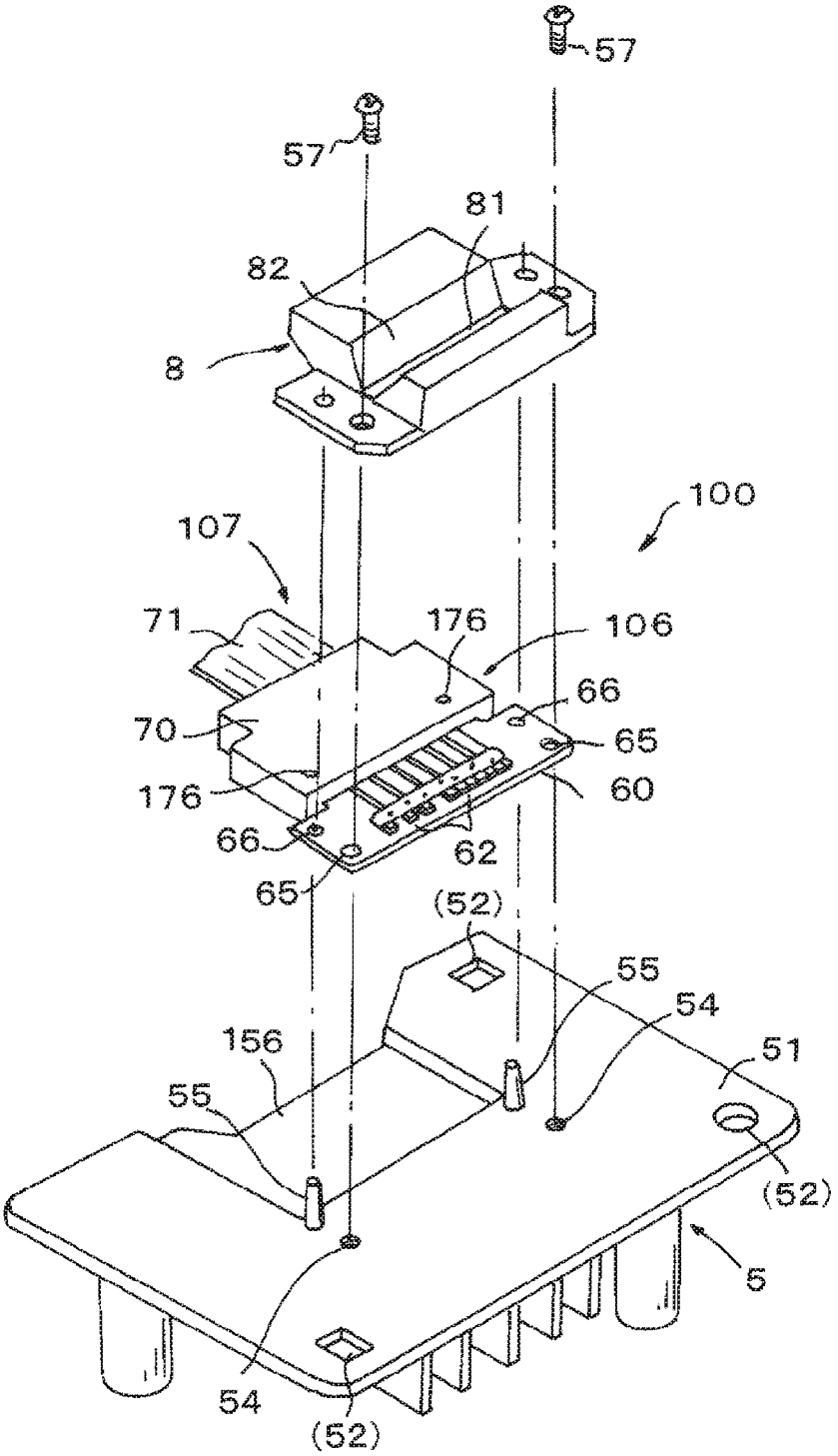
FIG. 10 is an exploded perspective view of the light source unit.
Figure 11:
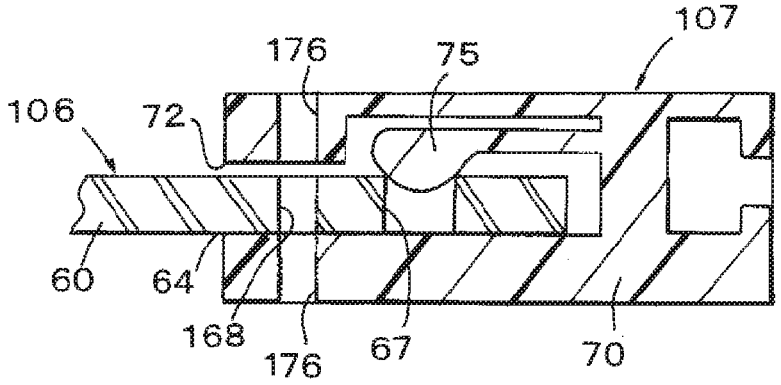
FIG. 11 is a cross-sectional view of a state where a card edge connector of the card type light source and the power supply connector are fitted together.

Further, small-diameter holes 176 are formed in the connector body 70. The holes 176 are circular as viewed from an upper surface side of the connector body 70, and are respectively formed in positions on both sides of the connector body 70 close to the front surface 70*a* so as to be opened in the thickness direction of the connector body 70. These holes 176 are formed so as to open at positions where the tubular groove 72 is present when the connector body 70 is assembled as shown in FIG. 10. The holes 176 are configured as position reference holes. The position reference holes 176 are formed at substantially the same diameter dimension as that of the alignment holes 168 provided in the card type light source 106. Here, substantially the same diameter dimension includes a case where the diameter dimensions of both are the same, and a case where the diameter dimensions of both are slightly different from each other. The position reference holes 176 are respectively formed at positions where centers of the alignment holes 168 and centers of the position reference holes 176 coincide with each other when the card edge connector 64 and the power supply connector 107 are fitted in a predetermined state (described later). That is, the alignment holes 168 are formed at positions concentric with the position reference holes 176.

FIG. 10 is an exploded perspective view of the light source unit 100. A shallow step portion 156 is formed on the base portion 51. The step portion 156 is formed in a region from one edge portion of the base portion 51 to the positioning bosses 55. The step portion 156 is configured with a concave portion in which a part of the main surface of the base portion 51 is recessed. The step portion 156 is formed to have a width dimension substantially equal to the width dimension of the connector body 70 of the power supply connector 107. A depth of the step portion 156 is formed to be substantially equal to a thickness dimension at which the connector body 70 projects on the back surface side of the card substrate 60 of the card type light source 106 when the power supply connector 107 and the card edge connector 64 are fitted together.

In order to assemble the light source unit 100, first, the card type light source 106 is fitted to and integrated with the power supply connector 107.

Next, as shown in FIG. 10, the card type light source 106 to which the power supply connector 107 is fitted is attached to the base portion 51 together with the reflector 8.

Accordingly, the assembly of the light source unit 100 is completed.

Thereafter, although a detailed description is omitted, as shown in FIG. 2, the projection lens 4 is attached to the base portion 51 through the lens holder 41, so as to constitute the lamp unit 2.

In order to reliably prevent a half-fitting state between the card type light source 106 and the power supply connector 107, in the light source unit 100 of the present embodiment as well, the alignment groove 69 serving as the alignment portion provided in the card type light source 106 functions effectively. That is, the fitting state can be confirmed by observing the transmission of light in the alignment groove 69.

Figure 12A:
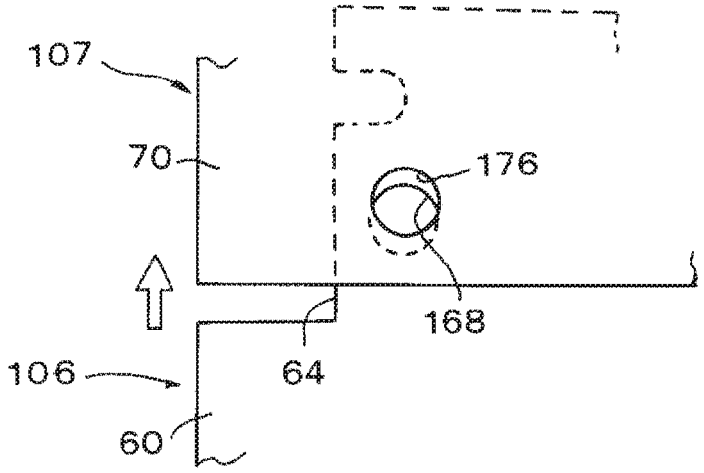
FIG. 12A is a schematic view illustrating a method of confirming a fitting state between the card edge connector and the power supply connector with alignment holes.
Figure 12B:
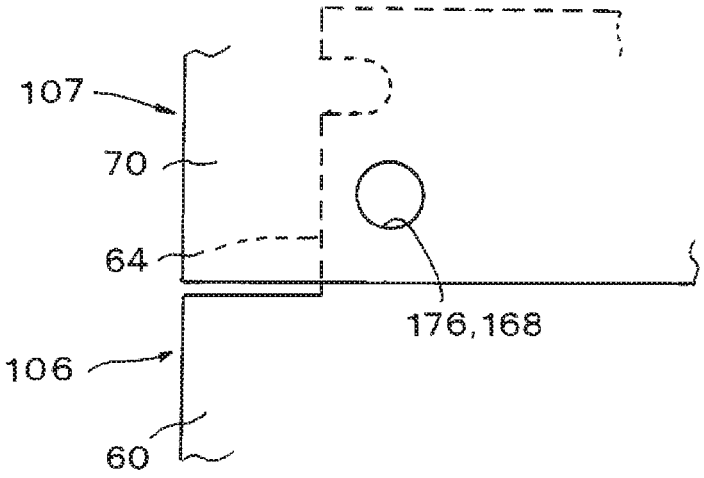
FIG. 12B is a schematic view illustrating the method of confirming the fitting state between the card edge connector and the power supply connector with the alignment holes.

Further, due to the alignment holes 168 as the alignment portion, the fitting state between the card type light source 106 and the power supply connector 107 can be confirmed. As shown in FIGS. 12A, 12B, and 13B, when the card edge connector 64 of the card type light source 106 is inserted into and fitted with the power supply connector 107, the position reference holes 176 of the connector body 70 and the alignment holes 168 of the card type light source 106 overlap each other. That is, when an inside of the position reference holes 176 is seen from an outside of the connector body 70, the alignment holes 168 are observed inside the position reference holes 176. At this time, as shown in FIG. 12A, when the card type light source 106 and the power supply connector 107 are half-fitted, center positions of the holes 168, 176 do not coincide with each other and are observed as a non-circular hole. On the other hand, as shown in FIG. 12B, when the card type light source 106 and the power supply connector 107 are correctly fitted, the center positions of the holes 168, 176 coincide with each other and are observed as a circular hole. Therefore, by confirming shapes of the holes observed at the center positions of the holes 168, 176 when the card type light source 106 and the power supply connector 107 are fitted together, the fitting state of the card type light source 106 and the power supply connector 107 can be confirmed.

Figure 13A:
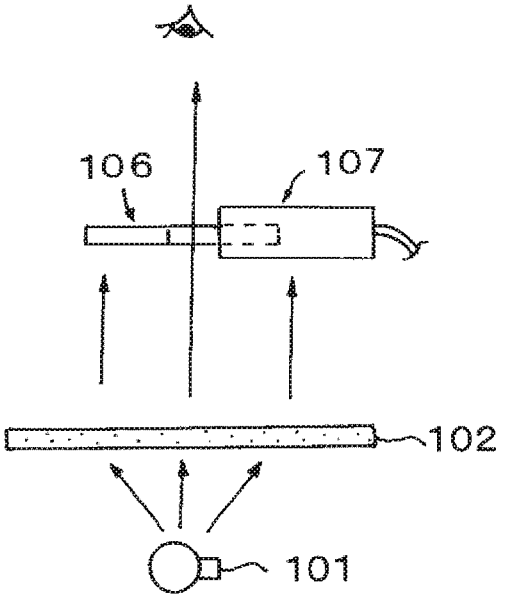
FIG. 13A is a schematic configuration diagram of a confirmation mechanism for confirming the fitting state.
Figure 13B:
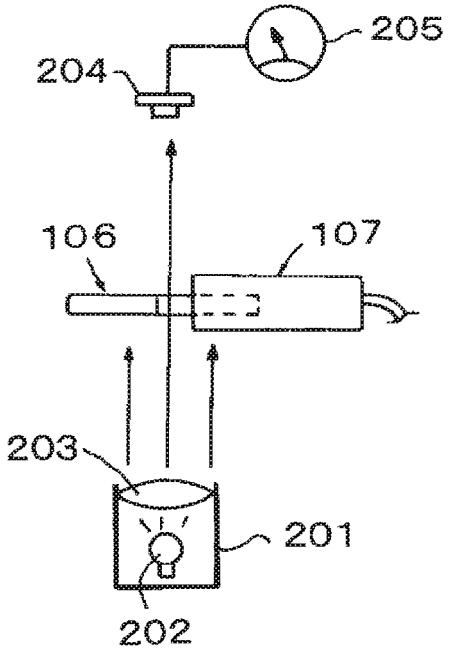
FIG. 13B is a schematic configuration diagram of a confirmation mechanism for confirming the fitting state.

When the fitting between the card type light source 106 and the power supply connector 107 is confirmed by using the alignment groove 69 or the alignment holes 168, it is preferable to use a confirmation mechanism shown in FIGS. 13A and 13B, for example. FIG. 13A shows confirmation of the fitting state by the worker's visual observation. As shown in FIG. 13A, a light diffusion plate 102 is disposed on a lower side of a work table for fitting the card type light source 106 and the power supply connector 107. An illumination light source 101 is disposed below the light diffusion plate 102.

The confirmation mechanism shown in FIG. 13A will be described. First, the illumination light source 101 is turned on, and the light diffusion plate 102 is irradiated with light. The light diffusion plate 102 is configured as a uniform surface light source when light is irradiated by the illumination light source 101. Therefore, when the alignment groove 69 or the alignment holes 168 are viewed while the card type light source 106 and the power supply connector 107 are fitted together on the light diffusion plate 102, a state where the alignment groove 69 is completely covered to be hidden by the power supply connector 107 or a shape of bright holes observed inside the position reference holes 176 can be easily confirmed. Accordingly, fitting between the card type light source 106 and the power supply connector 107 can be reliably confirmed.

FIG. 13B shows a case in which the fitting state is confirmed photoelectrically. As shown in FIG. 13B, a light source unit 201 is disposed on the lower side of the work table for fitting (not shown). The light source unit 201 is configured to emit parallel light having a predetermined light flux diameter toward a vertically upper side of the light source unit 201. The vertically upper side of the light source unit 201 is a direction indicated by an arrow in FIG. 13B. The light source unit 201 can be realized by, for example, a light source 202 such as an LED and a collimator lens 203.

A light receiving unit 204 such as a light receiving element is disposed directly above the light source unit 201. A light amount of light received by the light receiving unit 204 from the light source unit 201 is detected by a light amount meter 205 or the like.

The confirmation mechanism shown in FIG. 13B will be described. The card type light source 106 and the power supply connector 107 are fitted on an optical path of the light emitted from the light source unit 201. The light from the light source unit 201 passes through the alignment groove 69 or the alignment holes 168 from below and is received by the light receiving unit 204. Therefore, in a case of the alignment groove 69, when the amount of light received by the light receiving unit 204 becomes approximately zero, it can be confirmed that the card type light source 106 is correctly fitted to the power supply connector 107. In a case of the alignment holes 168, when the amount of light received by the light receiving unit 204 becomes a maximum peak, it can be confirmed that the card type light source 106 is correctly fitted to the power supply connector 107.

Figure 14A:
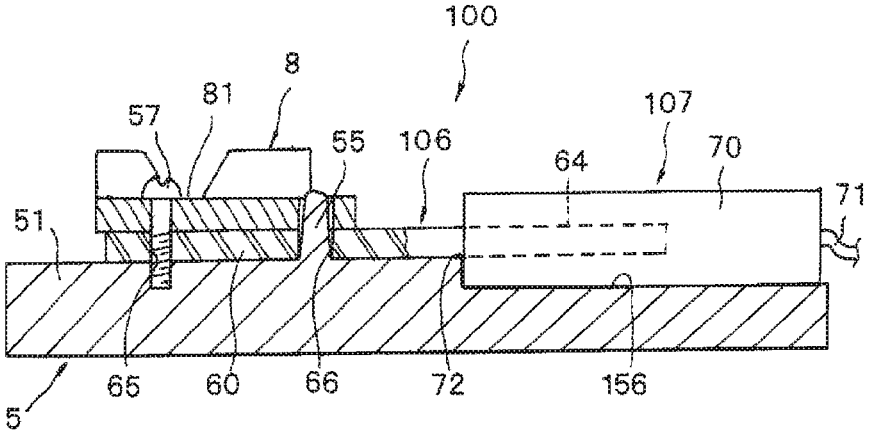
FIG. 14A is a cross-sectional view of a state where the card type light source is attached to a base portion.

Next, a state where the card type light source 106 is attached to the main surface of the base portion 51 is shown in FIG. 14A.

The card type light source 106 is attached in a state where the front surface on which the LED 62 is mounted is directed forward of the lamp unit 2 and in which the back surface thereof is in close contact with the main surface of the base portion 51. A part of the power supply connector 107 fitted to the card type light source 106 via the card edge connector 64 protrudes in the thickness direction on the back surface side of the card type light source 106. Therefore, when the card type light source 106 is brought into close contact with the main surface of the base portion 51, the power supply connector 107 is required to be disposed at a side position deviated from the main surface of the base portion 51. However, in this case, it is difficult to reduce the size of the light source unit 100.

In the present embodiment, as shown in FIG. 14A, the step portion 156 is provided on the base portion 51. Therefore, when the back surface of the card type light source 106 is brought into close contact with the main surface of the base portion 51, the power supply connector 107 is accommodated in the step portion 156.

Therefore, a position of the light source, particularly positions of the LEDs 62 in an optical axis direction of the lamp unit 2, can be accurately set by bringing the back surface of the card type light source 106 into close contact with the main surface of the base portion 51.

A height dimension including the card type light source 106 and the power supply connector 107 on the main surface of the base portion 51 can be reduced corresponding to the depth dimension of the step portion 156, and the thickness of the light source unit 100 can be reduced. Further, since it is not necessary to dispose the power supply connector 107 at a position protruding toward the side of the base portion 51, the size of the light source unit 100 can be reduced.

First Modification of Second Embodiment

Figure 14B:
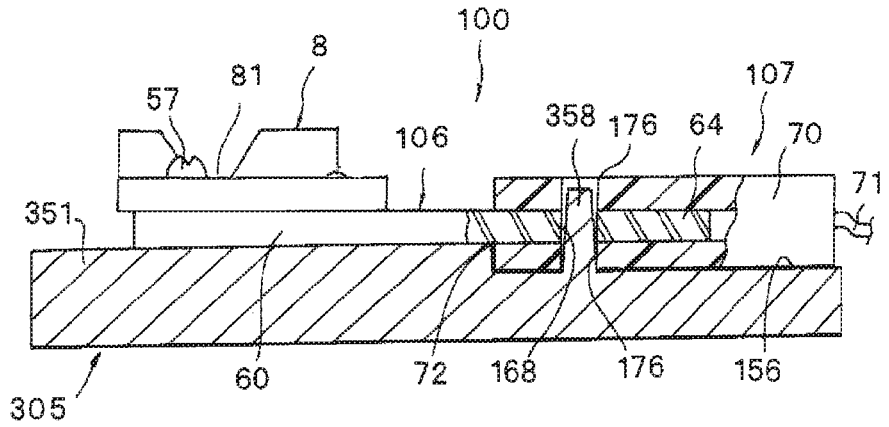
FIG. 14B is a cross-sectional view of a state where the card type light source is attached to the base portion.
Figure 15:
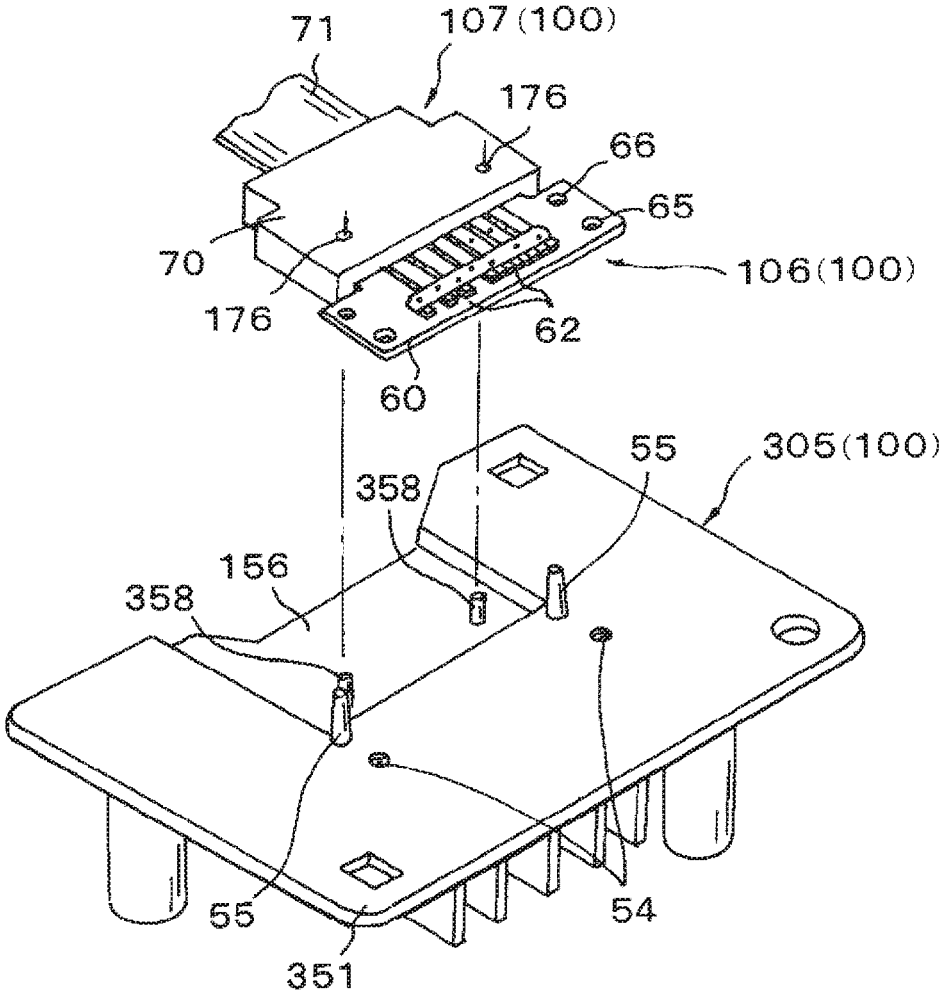
FIG. 15 is a perspective view of a modification of the base portion.

Next, a modification of the base portion 51 of the heat sink 5 will be described. FIG. 14B is a cross-sectional view of a state where the card type light source 106 is attached to the main surface of a base portion 351. FIG. 15 is a view showing the base portion 351 of a heat sink 305. In FIGS. 14B and 15, portions equivalent to the configuration shown in FIG. 10 are denoted by the same reference numerals.

In this modification, conical or columnar position fixing bosses 358 are erected at two positions of the step portion 156 provided on the base portion 351. The position fixing bosses 358 are provided at positions of the base portion 351 at which the alignment holes 168 of the card type light source 106 are positioned when the power supply connector 107 is correctly fitted to the card type light source 106 and then the power supply connector 107 and the card type light source 106 are attached to the base portion 351. The position fixing bosses 358 are formed at substantially the same diameter dimension as the diameter dimension of the corresponding alignment holes 168 and position reference holes 176.

By providing the position fixing bosses 358, it becomes easy to attach the card type light source 106 to the base portion 351. That is, if the card type light source 106 and the power supply connector 107 are correctly fitted together, the position fixing bosses 358 shown in FIG. 14B are smoothly inserted into the alignment holes 168 and the position reference holes 176 when the card type light source 106 is attached to the base portion 351.

When the card type light source 106 and the power supply connector 107 are fitted together in the half-fitting state, the position fixing bosses 358 are not inserted into the alignment holes 168 and the position reference holes 176, and the card type light source 106 cannot be attached to the base portion 351. However, if the power supply connector 107 and the card type light source 106 are moved at this time such that the alignment holes 168 and the position reference holes 176 are inserted by the position fixing bosses 358, peripheral surfaces of the position fixing bosses 358 are brought into contact with inner surfaces of the holes 168, 176, so that the card type light source 106 is forcibly moved with respect to the power supply connector 107. Accordingly, the power supply connector 107 and the card type light source 106 can be corrected to the correct fitting state.

Since the position fixing bosses 358 are inserted through the position reference holes 176 and the alignment holes 168, when the card type light source 106 is attached to the base portion 351, the position fixing bosses 358 restricts the positions of the power supply connector 107 with respect to the base portion 351. Therefore, the power supply connector 107 can be prevented from coming off from the base portion 351 due to disengagement of the power supply connector 107.

Instead of the position fixing bosses 358, the power supply connector 107 and the card type light source 106 may be fixed to the base portion 351 by screws (not shown) inserted into the position reference holes 176 and the alignment holes 168.

Second Modification of Second Embodiment

Figure 16:
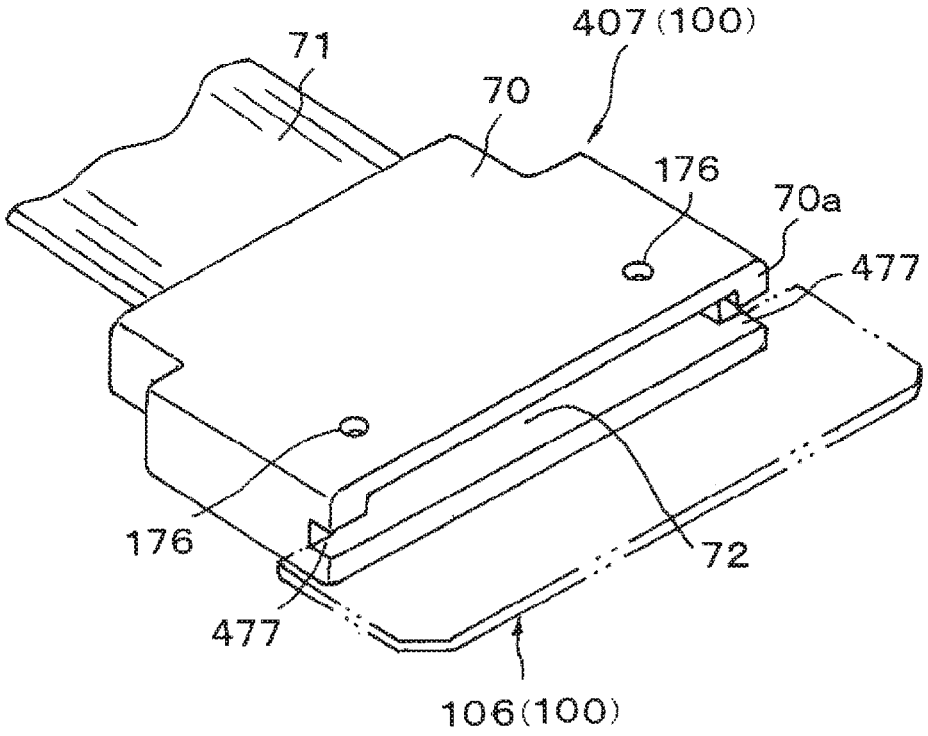
FIG. 16 is a perspective view of a modification of the power supply connector.

Next, a modification of the power supply connector 107 will be described. FIG. 16 shows a power supply connector 407 according to a second modification. As shown in FIG. 16, clearance portions 477 may be provided in the power supply connector 407. The clearance portions 477 are formed in a shape in which both side portions of the front surface 70*a* of the connector body 70 are notched backward. A dimension of the clearance portions 477 in the thickness direction is at least a dimension larger than the plate thickness of the card substrate 60 of the card type light source 106. Further, a dimension of a depth of the clearance portions 477 is formed as large as practical. A thickness direction of the clearance portions 477 is a direction along the upper-lower direction in FIG. 16 and is the thickness direction of the connector body 70. The dimension of the depth of the clearance portions 477 is a dimension in a direction along the front-rear direction of the connector body 70.

By providing the clearance portions 477, when the card type light source 106 is fitted to the power supply connector 407, the card type light source 106 and the power supply connector 407 can be fitted in a state where the front surface 70*a* of the connector body 70 enters from the edge portion of the connector portion 60B of the card substrate 60 by the depth dimension of the clearance portions 477. Therefore, even when a tolerance or manufacturing error occurs in the connector body 70 or the card substrate 60, the card type light source 106 can be fitted to a sufficiently deep position of the power supply connector 407. Accordingly, the card type light source 106 and the power supply connector 407 can be prevented from being in the half-fitting state due to tolerance and manufacturing error.

As described above, in the light source unit 100 of the present embodiment, when the card type light source 106 is attached to the base portion 51, 351 in the state where the power supply connector 107 is fitted to the card type light source 106, the power supply connector 107 is accommodated in the step portion 156 provided on the base portion 51, 351. Therefore, the card type light source 106 can be mounted in close contact with the base portion 51, 351, and the height dimension of the light source unit 100 can be reduced by the dimension of the step portion 156. Further, it is not necessary to dispose the power supply connector 107 outside the base portion 51, 351, and the size of the light source unit 100 can be reduced.

As described above, in the light source unit 100 of the present embodiment, when the card type light source 106 and the power supply connector 107 are fitted together, the fitting state thereof can be visually confirmed by using the alignment groove 69, 69A or the alignment holes 168. Therefore, even when a difference is present in the feeling of the operator with respect to the click feeling between the engagement pieces 75 and the engagement grooves 67, it is possible to reliably confirm the fitting state and to prevent the card type light source 106 and the power supply connector 107 from being in the half-fitting state. Thus, the reliability of the light source unit 100 can be improved.

Although omitted in the drawings, when a card substrate of a card type light source is formed, a plurality of card substrates are usually separated and divided from a single base plate to form the card substrate. At this time, when V-grooves are formed on a front surface of the base plate and the plurality of card substrates are divided by using the V-grooves, burrs are generated in places where card edge connectors are formed. That is, burrs are generated at edge portions of the card substrates divided using the V-grooves. Use of a card substrate having such burrs causes damage to a power supply connector and electrical short circuit due to the burrs.

In the present disclosure, when the plurality of card substrates are formed from the base plate, at least the edge portions constituting the card edge connector are formed by shearing via press working or the like. Accordingly, generation of burrs at the edge portions of the card edge connectors can be prevented, damage to the power supply connectors and electrical short circuit can be prevented, and reliability of the light source unit is improved.

Although the embodiments of the present disclosure are described above, the technical scope of the present disclosure should not be limitedly interpreted by the description of the present embodiments. The present embodiments are merely examples and it is to be appreciated by those skilled in the art that various modifications of the embodiments can be made within the scope of the invention described in the claims.

Although examples in which the alignment grooves are provided in the card type light source as the alignment portion of the first embodiment and the second embodiment are described, the alignment portion in the present disclosure is not limited to the example described above. The alignment grooves may be formed in the power supply connector for confirmation of the fitting position with the card type light source.

Although an example in which the alignment holes and the alignment grooves are formed in the card type light source as the alignment portion of the second embodiment is described, the alignment portion in the present disclosure is not limited to the example described above. The alignment holes and the alignment grooves may be formed in the power supply connector for confirmation of the fitting position with the card type light source.

Although the second embodiment describes a configuration in which the light source unit has both the alignment grooves and the alignment holes (position reference holes) as alignment reference, the alignment of the present disclosure is not limited thereto. Only one of the alignment grooves and the alignment holes (position reference holes) may be provided.

Although the first embodiment and the second embodiment describe examples in which the alignment grooves are notched from the edge portion of the card substrate, the configuration of the alignment grooves of the present disclosure is not limited to this example. The alignment grooves may be long grooves formed over a required region including a portion where the front surface of the connector body is located when the card type light source and the power supply connector are fitted together.

Further, although an example in which the alignment holes are circular is described in the second embodiment, the shape of the alignment holes is not limited to this example. The alignment holes may be any other shape, such as a triangular hole, a rectangular hole, or an elliptical hole, as long as it can determine relative positions with respect to the position reference holes.

The alignment portion provided in the card type light source is not limited to the alignment grooves and the alignment holes described in the second embodiment. As the alignment portion, for example, an alignment mark may be formed by using a part of a resist or conductive film formed on the card substrate, and the fitting position of the power supply connector may be confirmed using the alignment mark.

It is needless to say that the present disclosure is not limited to the light source unit applied to the high beam light distribution lamp unit described in the above embodiments, and can be configured as a light source unit applied to a lamp unit for low beam light distribution or a lamp unit of another light distribution.

This application is based on Japanese Patent Application No. 2017-238240 filed on Dec. 13, 2017 and Japanese Patent Application No. 2017-238241 filed on Dec. 13, 2017, the contents of which are incorporated herein as reference.

The invention claimed is:

1. A light source unit comprising:

a card type light source, the card type light source comprising:

a light source;

a card substrate on which the light source is mounted; and a card edge connector that is formed on a part of the card substrate; and a power supply connector configured to supply power to the light source of the card type light source, wherein the power supply connector is configured to be fitted to the card type light source via the card edge connector, wherein one of the card type light source and the power supply connector is provided with an alignment portion for confirming an alignment state with respect to the other, wherein the alignment portion includes an alignment groove formed on the card type light source and extending in a direction in which the card type light source is fitted to the power supply connector, and wherein the alignment groove is configured to be covered so as to be completely hidden by the power supply connector when viewed from a direction perpendicular to a surface of the card substrate upon which the light source is mounted, when the card type light source is correctly fitted to the power supply connector.

2. The light source unit according to claim 1, wherein the power supply connector includes a connector body into which the card edge connector is inserted, and wherein the power supply connector is formed such that an end surface of the connector body facing a side on which the card type light source is inserted is to be located at the same position as a base end of the alignment groove when the card type light source is correctly fitted.

3. The light source unit according to claim 1, further comprising:

a base portion to which the card type light source is attached, wherein the card type light source is attached to the base portion in a state where a back surface of the card substrate opposite to a side on which the light source is mounted is in close contact with a main surface of the base portion.

4. A light source unit comprising:

a card type light source, the card type light source comprising:

a light source;

a card substrate on which the light source is mounted; and a card edge connector that is formed on a part of the card substrate;

a power supply connector configured to supply power to the light source of the card type light source; and a base portion to which the card type light source is attached, wherein the power supply connector is configured to be fitted to the card type light source via the card edge connector, and wherein the base portion is formed with a step portion in a region corresponding to the power supply connector.

5. The light source unit according to claim 4, wherein the card type light source is attached in a state where a back surface of the card substrate opposite to a side on which the light source is mounted is in close contact with a main surface of the base portion, and wherein the step portion is provided on a part of the main surface and is formed in a concave shape configured to accommodate a connector body of the power supply connector.

6. The light source unit according to claim 5, wherein the connector body of the power supply connector is configured so as not to protrude outward from the base portion.

7. The light source unit according to claim 4, wherein one of the card type light source and the power supply connector is provided with an alignment portion for confirming an alignment state with respect to the other.

8. The light source unit according to claim 7, wherein the alignment portion includes an alignment groove formed on the card type light source and extending in a direction in which the card type light source is fitted to the power supply connector, and wherein the alignment groove is configured to be covered to be hidden by the power supply connector when the power supply connector is correctly fitted to a power receiving connector.

9. The light source unit according to claim 8, wherein the card type light source includes a plurality of light emitting elements arranged at different arrangement densities, and a plurality of conductive patterns respectively connected to the plurality of light emitting elements, and wherein the alignment groove is provided in one of: a boundary position between a region in which the conductive patterns connected to the light emitting elements arranged at a relatively high density are provided and a region in which the conductive patterns connected to the light emitting elements arranged at a relatively low density are provided; and the region in which the conductive patterns connected to the light emitting elements arranged at the relatively low density are provided.

10. The light source unit according to claim 7, wherein the alignment portion includes an alignment hole opened in the card type light source, and the alignment hole is configured to be observed in a position reference hole opened in the power supply connector in a state of being disposed at a position concentric with the position reference hole when the power supply connector is correctly fitted.

11. The light source unit according to claim 10, wherein the alignment hole and the position reference hole are circular holes having the same diameter dimension.

12. The light source unit according to claim 10, wherein the base portion includes, in the step portion, a position fixing boss to be inserted into the alignment hole and the position reference hole.

13. The light source unit according to claim 4, wherein the power supply connector includes a connector body having a flat tubular groove into which the card edge connector is to be inserted, and wherein the connector body is formed with a clearance portion for preventing interference with the card type light source at a portion facing the card type light source.

* * * * *